US008381922B2

(12) United States Patent
Chung et al.

(10) Patent No.: US 8,381,922 B2
(45) Date of Patent: Feb. 26, 2013

(54) SHELF THAT CAN BE FOLDED EASILY AND QUICKLY

(75) Inventors: Chen-Yu Chung, Taichung (TW); Zi-Cong Wen, Dongguan (CN); Cheng-Chun Wang, Changhua (TW); Sheng-Chi Chung, Taichung (TW)

(73) Assignee: Shih-Ming Lin, Dongguan (CN)

( * ) Notice: Subject to any disclaimer, the term of this patent is extended or adjusted under 35 U.S.C. 154(b) by 171 days.

(21) Appl. No.: 12/848,265

(22) Filed: Aug. 2, 2010

(65) Prior Publication Data

US 2012/0024810 A1 Feb. 2, 2012

(51) Int. Cl.
*A47B 43/00* (2006.01)
*A47B 96/14* (2006.01)
*A47B 47/00* (2006.01)

(52) U.S. Cl. ..... 211/149; 211/186; 108/193; 312/258

(58) Field of Classification Search ..... 211/85, 211/132.1, 149, 150, 169, 186, 187, 188, 211/194, 195; 108/99, 115, 184, 193; 312/7.2, 312/258, 262
See application file for complete search history.

(56) References Cited

U.S. PATENT DOCUMENTS

| | | | | | |
|---|---|---|---|---|---|
| 771,731 | A * | 10/1904 | Johnson | 312/114 |
| 3,294,464 | A * | 12/1966 | Lew | 312/258 |
| 4,703,981 | A * | 11/1987 | Stewart | 312/258 |
| 4,974,526 | A * | 12/1990 | Wiygul, Jr. | 108/159 |
| 5,882,098 | A * | 3/1999 | Brown et al. | 312/258 |
| 6,672,465 | B2 * | 1/2004 | White et al. | 211/186 |
| 6,722,750 | B2 * | 4/2004 | Chan | 312/258 |
| 7,191,908 | B2 * | 3/2007 | De Rijk | 211/191 |
| 7,337,732 | B2 * | 3/2008 | Becker et al. | 108/193 |
| 7,631,952 | B2 * | 12/2009 | Chiang | 312/258 |
| 7,913,863 | B2 * | 3/2011 | Lin | 211/186 |
| 8,015,930 | B2 * | 9/2011 | Huang | 108/193 |
| 8,015,931 | B2 * | 9/2011 | Lin | 108/193 |
| 8,136,462 | B2 * | 3/2012 | Lin | 108/193 |
| 2003/0057171 | A1 * | 3/2003 | Wang | 211/195 |
| 2003/0102781 | A1 * | 6/2003 | White et al. | 312/7.2 |
| 2006/0230993 | A1 * | 10/2006 | Becker et al. | 108/180 |
| 2010/0116764 | A1 * | 5/2010 | Lin | 211/149 |
| 2010/0122964 | A1 * | 5/2010 | Lin | 211/149 |
| 2010/0122965 | A1 * | 5/2010 | Lin | 211/186 |
| 2010/0126952 | A1 * | 5/2010 | Huang | 211/134 |
| 2011/0001339 | A1 * | 1/2011 | Krueger | 297/135 |
| 2011/0011816 | A1 * | 1/2011 | Marietta et al. | 211/149 |
| 2011/0017692 | A1 * | 1/2011 | Marietta et al. | 211/195 |
| 2011/0115350 | A1 * | 5/2011 | Tsai et al. | 312/262 |
| 2012/0007484 | A1 * | 1/2012 | Tsai et al. | 312/262 |

* cited by examiner

*Primary Examiner* — Jonathan Liu
*Assistant Examiner* — Joshua Rodden
(74) *Attorney, Agent, or Firm* — Alan Kamrath; Kamrath IP Lawfirm, P.A.

(57) ABSTRACT

A shelf includes a rear frame, two side frames pivotally mounted on two opposite ends of the rear frame respectively, two connecting frames each detachably mounted on the rear frame and each located between the two side frames to locate the two side frames, and at least one placement board mounted between and supported by the rear frame and the two side frames. Thus, the shelf can be folded to have a smaller volume so as to decrease the cost of packaging, storage and transportation of the shelf.

3 Claims, 10 Drawing Sheets

SHELF THAT CAN BE FOLDED EASILY AND QUICKLY

BACKGROUND OF THE INVENTION

1. Field of the Invention

The present invention relates to a support device and, more particularly, to a shelf for supporting an electronic appliance, such as a television, computer and the like.

2. Description of the Related Art

A conventional shelf is used for supporting an electronic appliance, such as a television, computer and the like. However, the conventional shelf cannot be folded to have a smaller volume when not in use, thereby increasing the cost of packaging, storage and transportation of the shelf. In addition, the conventional shelf is not assembled and disassembled easily and quickly, thereby causing inconvenience to a user when assembling and disassembling the shelf.

BRIEF SUMMARY OF THE INVENTION

In accordance with the present invention, there is provided a shelf, comprising a rear frame, two side frames pivotally mounted on two opposite ends of the rear frame respectively, two connecting frames each detachably mounted on the rear frame and each located between the two side frames to locate the two side frames, and at least one placement board mounted between and supported by the rear frame and the two side frames.

The placement board is locked onto the rear frame and the two side frames by a plurality of threaded locking knobs. The placement board has a surface formed with a plurality of screw bores, and the threaded locking knobs are screwed into the screw bores of the placement board. The rear frame has a surface formed with a plurality of through holes, and the threaded locking knobs extend through the through holes of the rear frame. Each of the side frames has a surface formed with a plurality of through bores, and the threaded locking knobs extend through the through bores of each of the side frames.

Each of the two opposite ends of the rear frame has an upper portion and a lower portion each provided with a first pivot portion. Each of the two side frames has a rear end having an upper portion and a lower portion each provided with a second pivot portion pivotally connected with the respective first pivot portion of the rear frame by a pivot pin so that the rear end of each of the two side frames is pivotally connected with the rear frame.

In accordance with a first embodiment of the present invention, each of the two side frames has a front end having an upper portion and a lower portion each provided with a locking block. Each of the two connecting frames has a front side having two opposite ends each provided with a locking groove locked onto the locking block of each of the two side frames to lock each of the two connecting frames onto each of the two side frames. The locking block of each of the two side frames has a substantially dovetailed shape. The locking groove of each of the two connecting frames has a substantially dovetailed shape.

Each of the two connecting frames has a rear side detachably mounted on the rear frame by at least one threaded fastening knob. Each of the two connecting frames includes a lengthwise bar mounted between the two side frames and at least one crosswise bar mounted between the lengthwise bar and the rear frame.

In accordance with a second embodiment of the present invention, each of the two side frames has a front end having an upper portion and a lower portion each provided with a locking slot, and each of the two connecting frames has a front side having two opposite ends each provided with a locking ear locked onto the locking slot of each of the two side frames to lock each of the two connecting frames onto each of the two side frames.

The primary objective of the present invention is to provide a shelf that can be folded easily and quickly.

According to the primary advantage of the present invention, the shelf can be folded to have a smaller volume so as to decrease the cost of packaging, storage and transportation of the shelf.

According to another advantage of the present invention, the shelf is assembled and disassembled easily and quickly, thereby facilitating a user assembling and disassembling the shelf.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
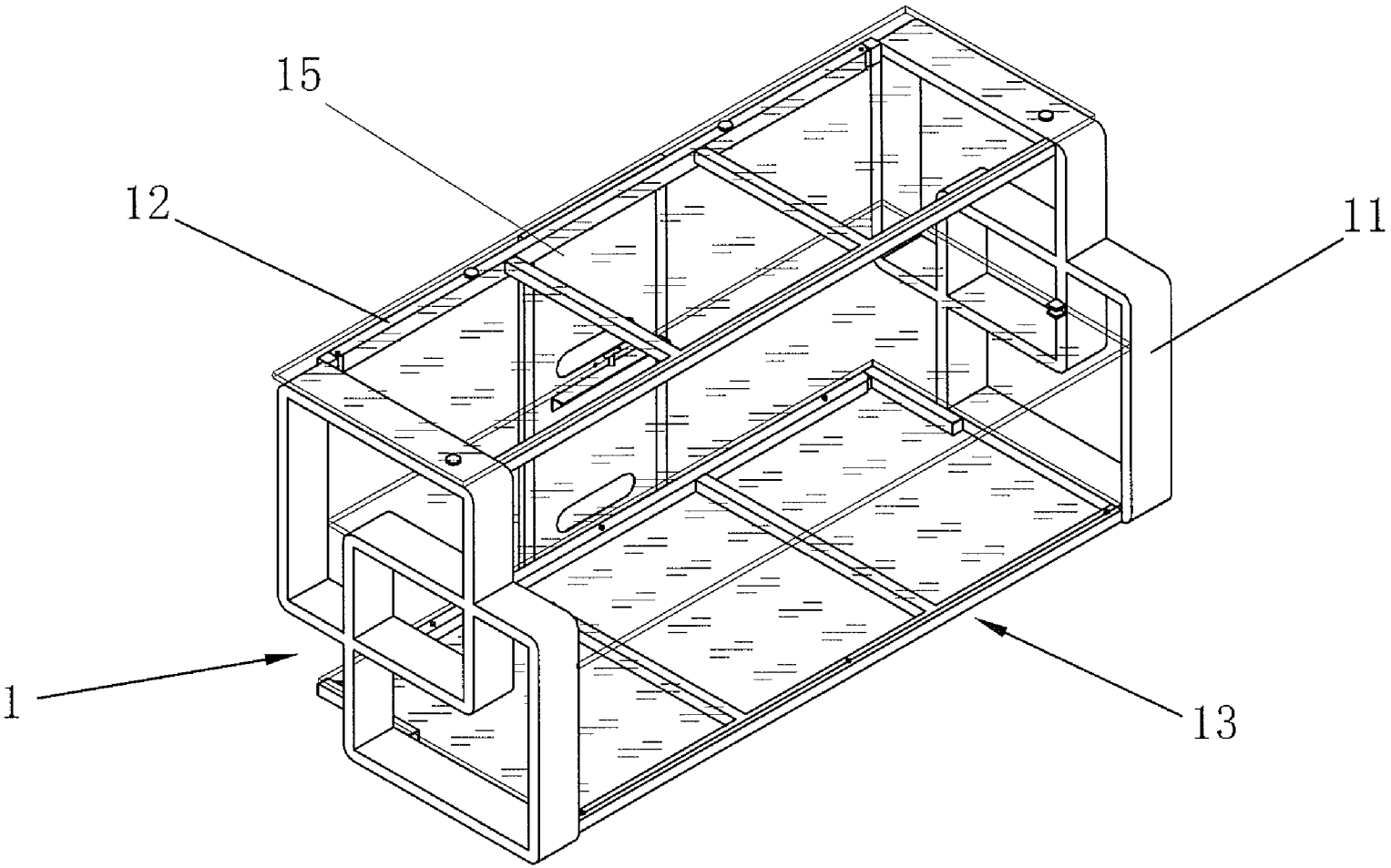
FIG. 1 is a perspective view of a shelf in accordance with the preferred embodiment of the present invention.
Figure 2:
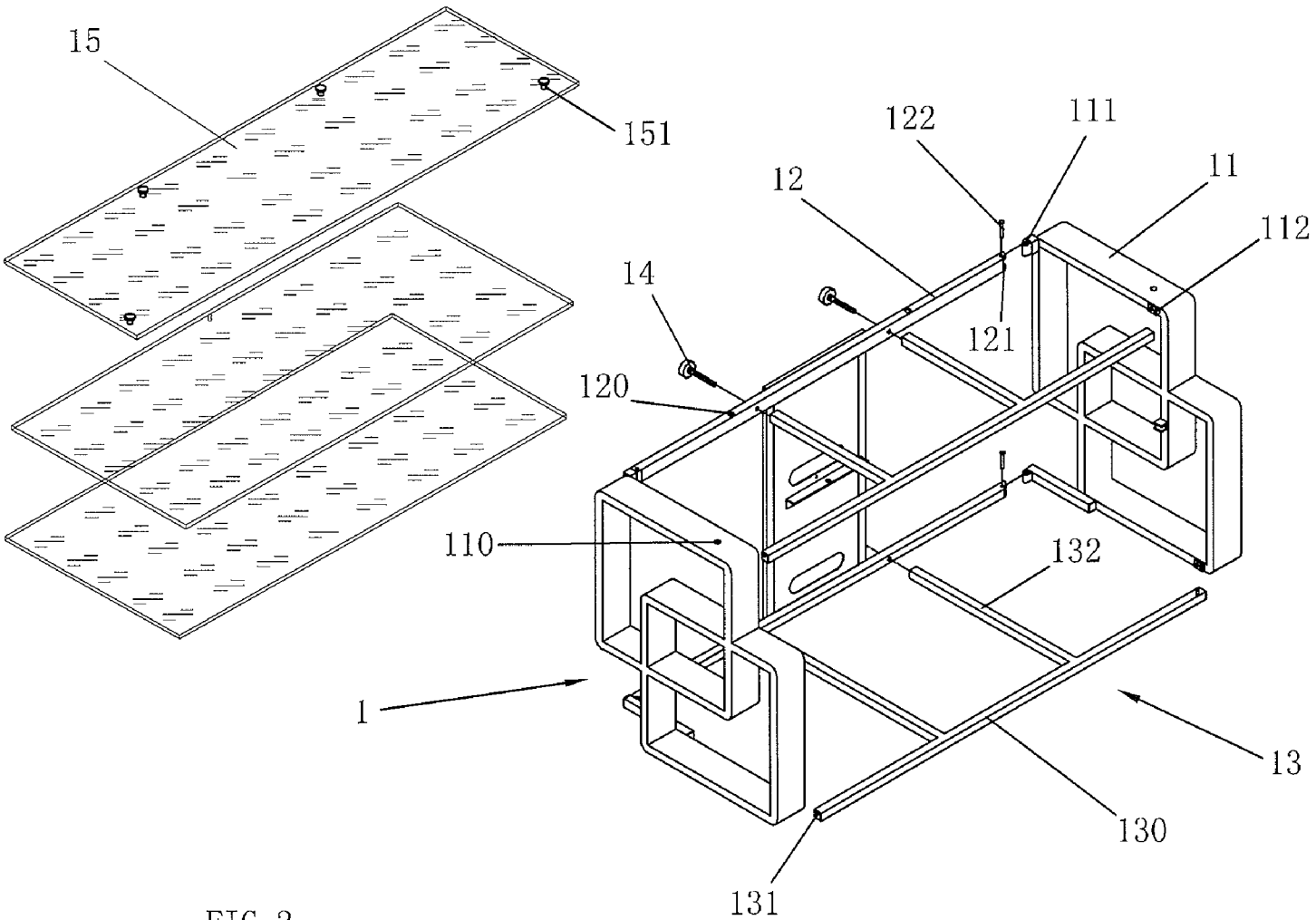
FIG. 2 is a partially exploded perspective view of the shelf as shown in FIG. 1.
Figures 3, 4:
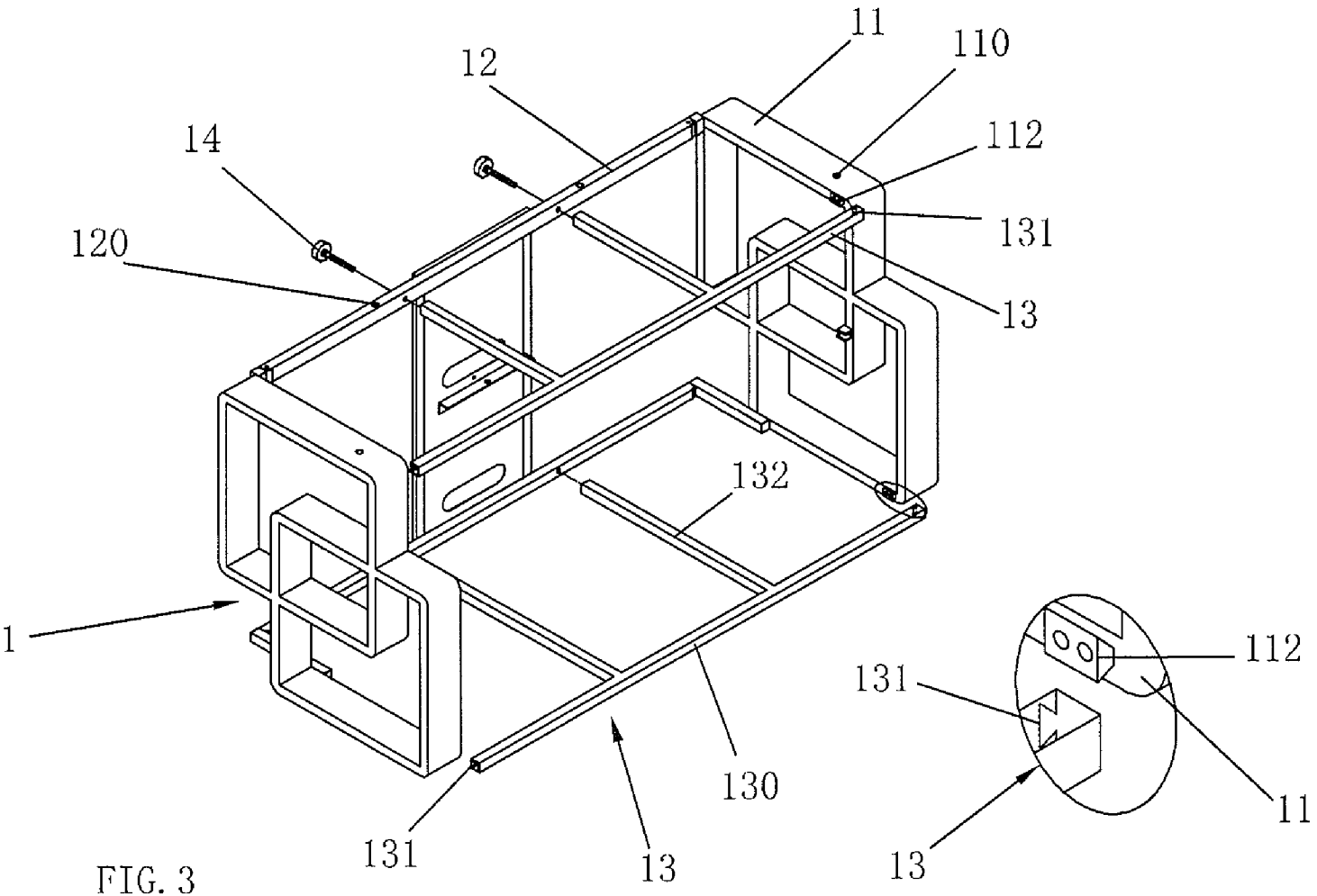
FIG. 3 is a partially exploded perspective view of the shelf as shown in FIG. 1.
FIG. 4 is a locally enlarged view of the shelf as shown in FIG. 3.
Figure 5:
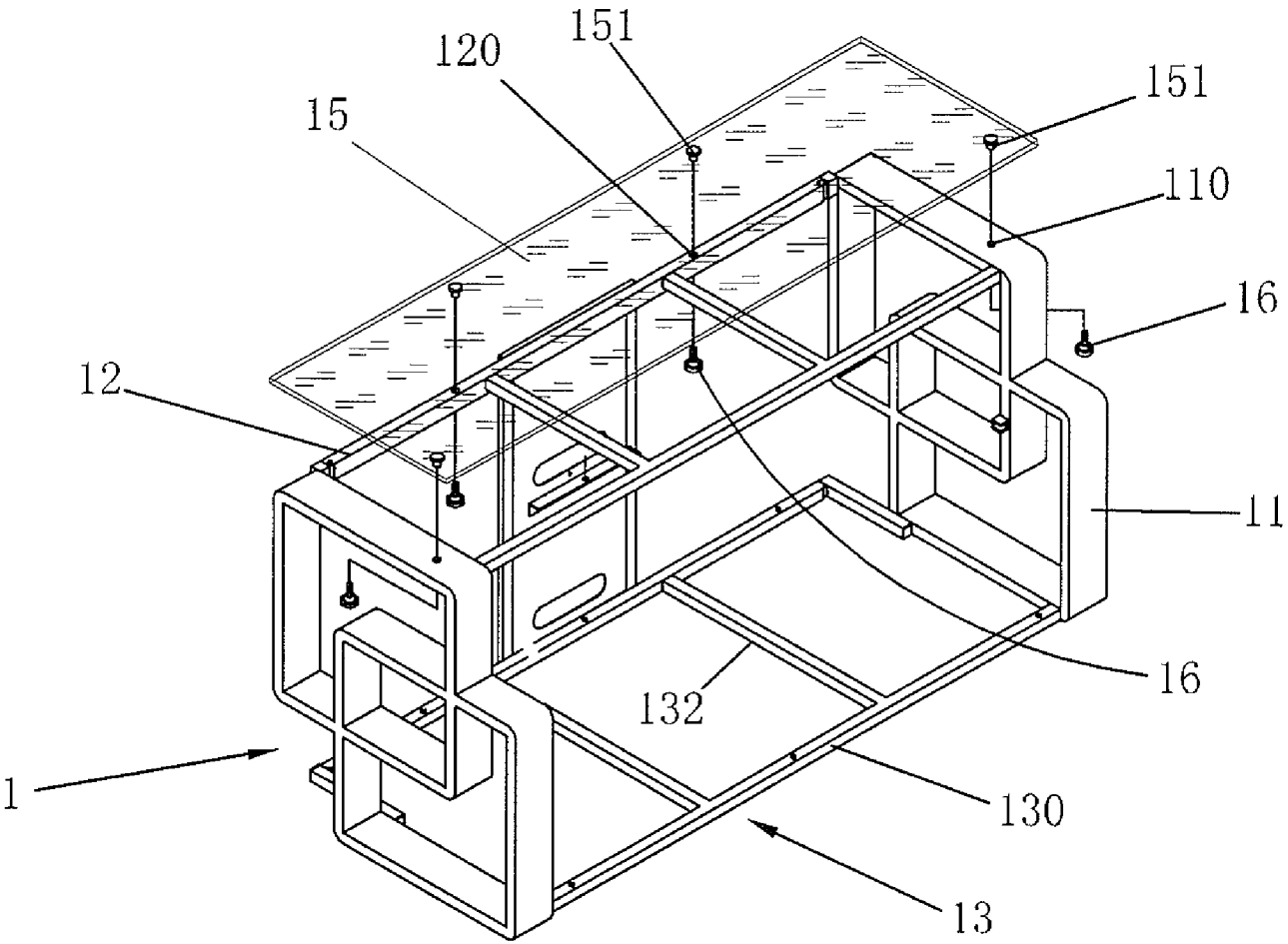
FIG. 5 is a partially exploded perspective view of the shelf as shown in FIG. 1.

Referring to the drawings and initially to FIGS. 1-6, a shelf 1 in accordance with the preferred embodiment of the present invention is used for supporting an electronic appliance, such as a television and the like. The shelf 1 comprises a rear frame 12, two side frames 11 pivotally mounted on two opposite ends of the rear frame 12 respectively, two connecting frames 13 each detachably mounted on the rear frame 12 and each located between the two side frames 11 to locate the two side frames 11, and at least one placement board 15 mounted between and supported by the rear frame 12 and the two side frames 11.

The placement board 15 is locked onto the rear frame 12 and the two side frames 11 by a plurality of threaded locking knobs 16. The placement board 15 has a surface formed with a plurality of screw bores 151, and the threaded locking knobs 16 are screwed into the screw bores 151 of the placement board 15.

The rear frame 12 has a surface formed with a plurality of through holes 120, and the threaded locking knobs 16 extend through the through holes 120 of the rear frame 12. Each of the two opposite ends of the rear frame 12 has an upper portion and a lower portion each provided with a first pivot portion 121.

Each of the side frames 11 has a surface formed with a plurality of through bores 110, and the threaded locking knobs 16 extend through the through bores 110 of each of the side frames 11. Each of the two side frames 11 has a rear end having an upper portion and a lower portion each provided with a second pivot portion 111 pivotally connected with the respective first pivot portion 121 of the rear frame 12 by a pivot pin 122 so that the rear end of each of the two side frames 11 is pivotally connected with the rear frame 12. Each of the two side frames 11 has a front end having an upper portion and a lower portion each provided with a locking block 112. The locking block 112 of each of the two side frames 11 has a substantially dovetailed shape.

Each of the two connecting frames 13 has a rear side detachably mounted on the rear frame 12 by at least one threaded fastening knob 14. Each of the two connecting frames 13 has a front side having two opposite ends each provided with a locking groove 131 locked onto the locking block 112 of each of the two side frames 11 to lock each of the two connecting frames 13 onto each of the two side frames 11. The locking groove 131 of each of the two connecting frames 13 has a substantially dovetailed shape. Each of the two connecting frames 13 includes a lengthwise bar 130 mounted between the two side frames 11 and at least one crosswise bar 132 mounted between the lengthwise bar 130 and the rear frame 12.

In assembly, the second pivot portion 111 of each of the two side frames 11 is pivotally connected with the respective first pivot portion 121 of the rear frame 12 by the pivot pin 122 so that the rear end of each of the two side frames 11 is pivotally connected with the rear frame 12. Then, the locking groove 131 of each of the two connecting frames 13 is locked onto the locking block 112 of each of the two side frames 11 to lock each of the two connecting frames 13 onto each of the two side frames 11. Then, the threaded fastening knobs 14 extend through the rear frame 12 and are screwed into each of the two connecting frames 13 to lock each of the two connecting frames 13 onto the rear frame 12. Then, the placement board 15 is placed on the rear frame 12 and the two side frames 11. Finally, the threaded locking knobs 16 extend through the through bores 110 of each of the side frames 11 and the through holes 120 of the rear frame 12 and are screwed into the screw bores 151 of the placement board 15 to lock the placement board 15 onto the side frames 11 and the rear frame 12 so as to assemble the shelf 1 as shown in FIG. 1.

Figure 6:
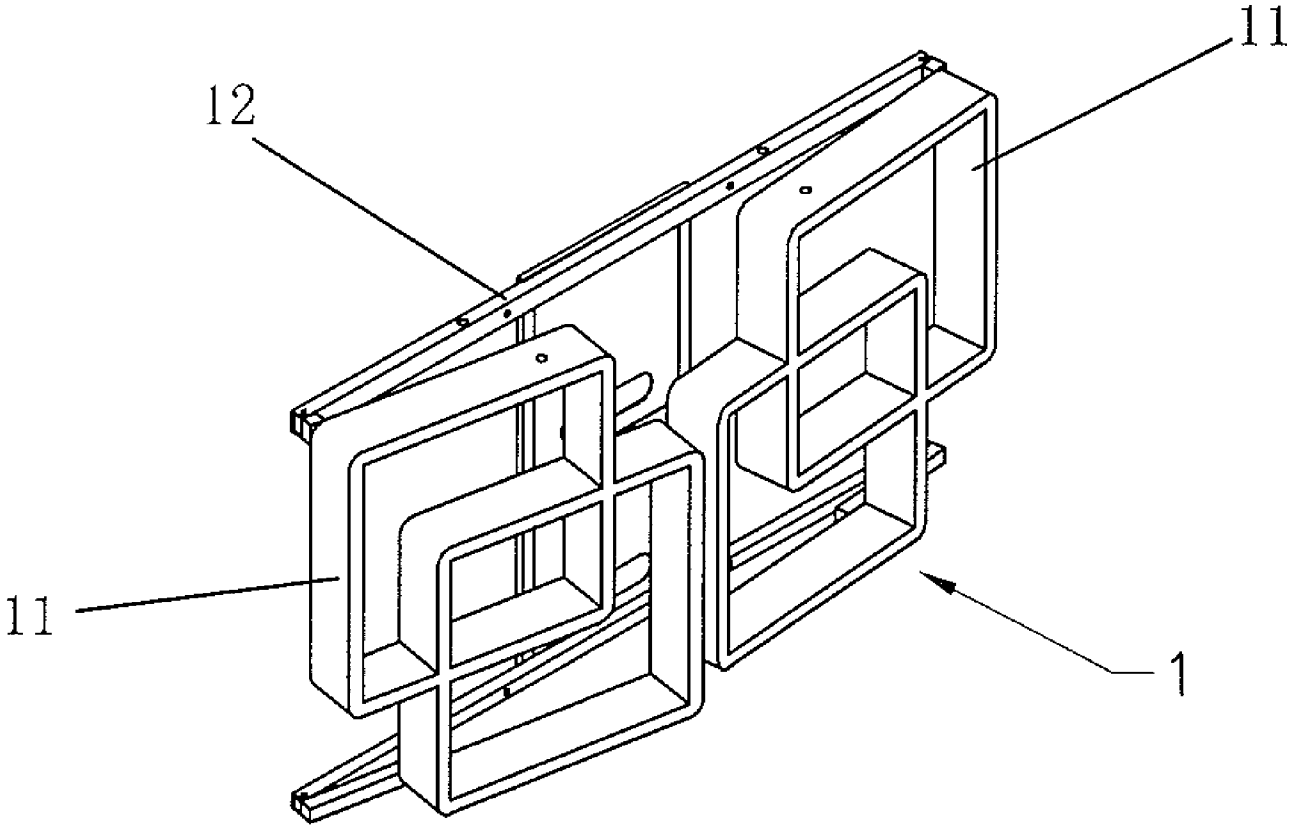
FIG. 6 is a perspective folded view of the shelf as shown in FIG. 1.

When not in use, the placement board 15 can be removed from the side frames 11 and the rear frame 12 by unscrewing the threaded locking knobs 16. Then, each of the two connecting frames 13 can be detached from the rear frame 12 by unscrewing the threaded fastening knobs 14. Then, each of the two connecting frames 13 can be removed from each of the two side frames 11 by detaching the locking groove 131 of each of the two connecting frames 13 from the locking block 112 of each of the two side frames 11. After each of the two connecting frames 13 is removed from the rear frame 12 and each of the two side frames 11, each of the two side frames 11 is pivoted relative to the rear frame 12 so that each of the two side frames 11 can be moved to abut the rear frame 12 so as to fold the shelf 1 as shown in FIG. 6.

Accordingly, the shelf 1 can be folded to have a smaller volume so as to decrease the cost of packaging, storage and transportation of the shelf 1. In addition, the shelf 1 is assembled and disassembled easily and quickly, thereby facilitating a user assembling and disassembling the shelf 1.

Figures 7, 8:
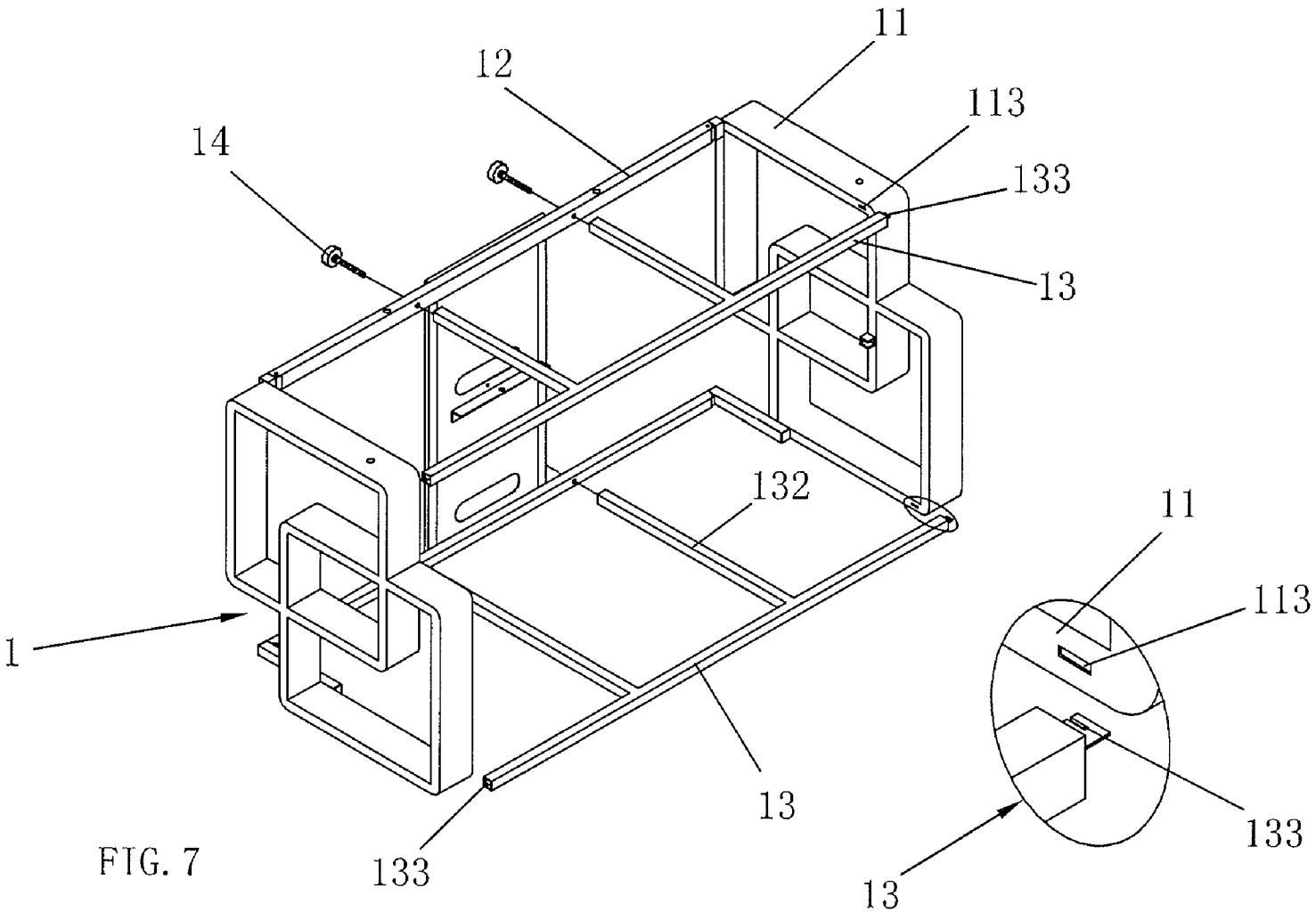
FIG. 7 is a partially exploded perspective view of a shelf in accordance with another preferred embodiment of the present invention.
FIG. 8 is a locally enlarged view of the shelf as shown in FIG. 7.

Referring to FIGS. 7 and 8, each of the two side frames 11 has a front end having an upper portion and a lower portion each provided with a locking slot 113, and each of the two connecting frames 13 has a front side having two opposite ends each provided with a locking ear 133 locked onto the locking slot 113 of each of the two side frames 11 to lock each of the two connecting frames 13 onto each of the two side frames 11.

Figure 9:
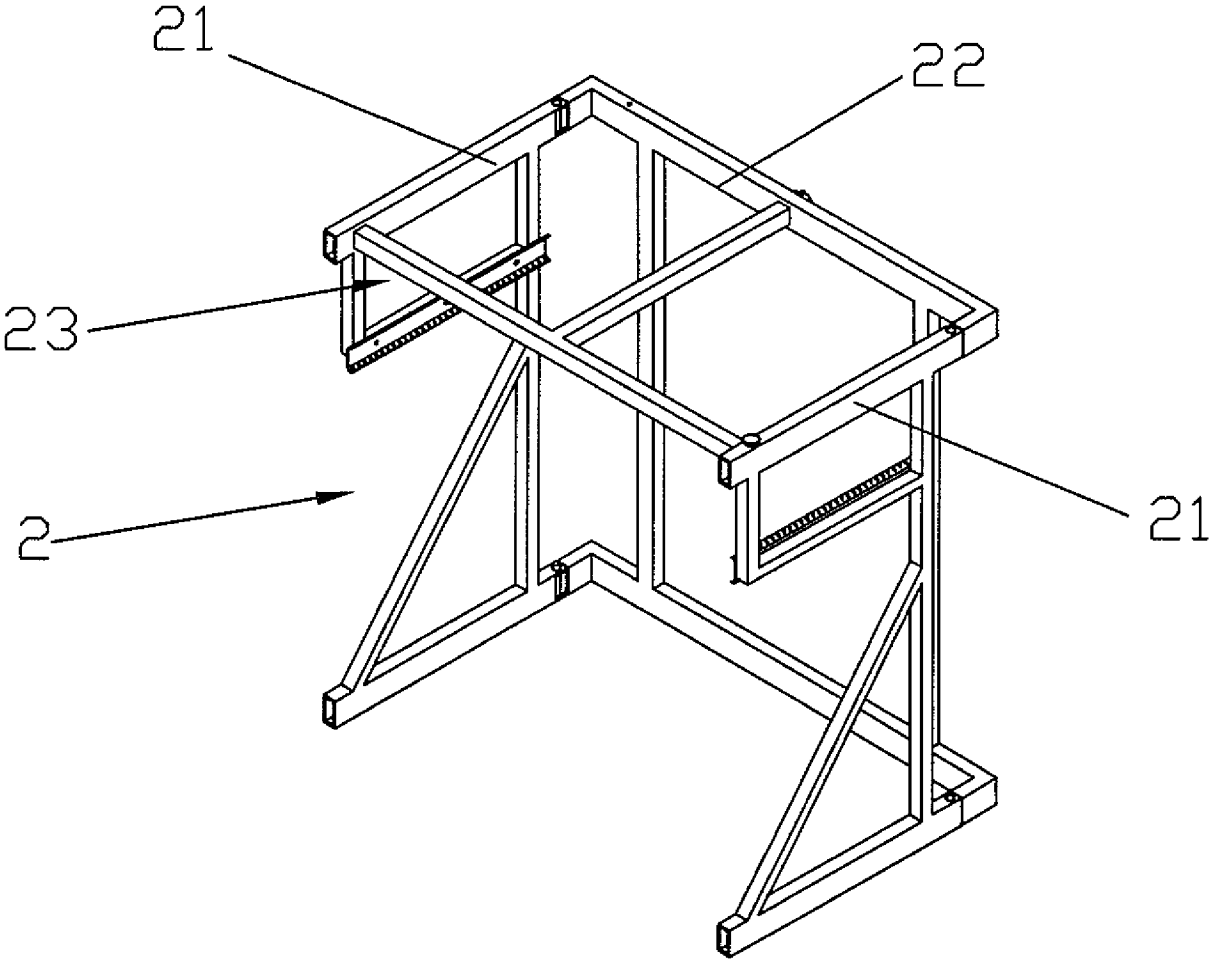
FIG. 9 is a perspective view of a shelf in accordance with another preferred embodiment of the present invention.
Figure 10:
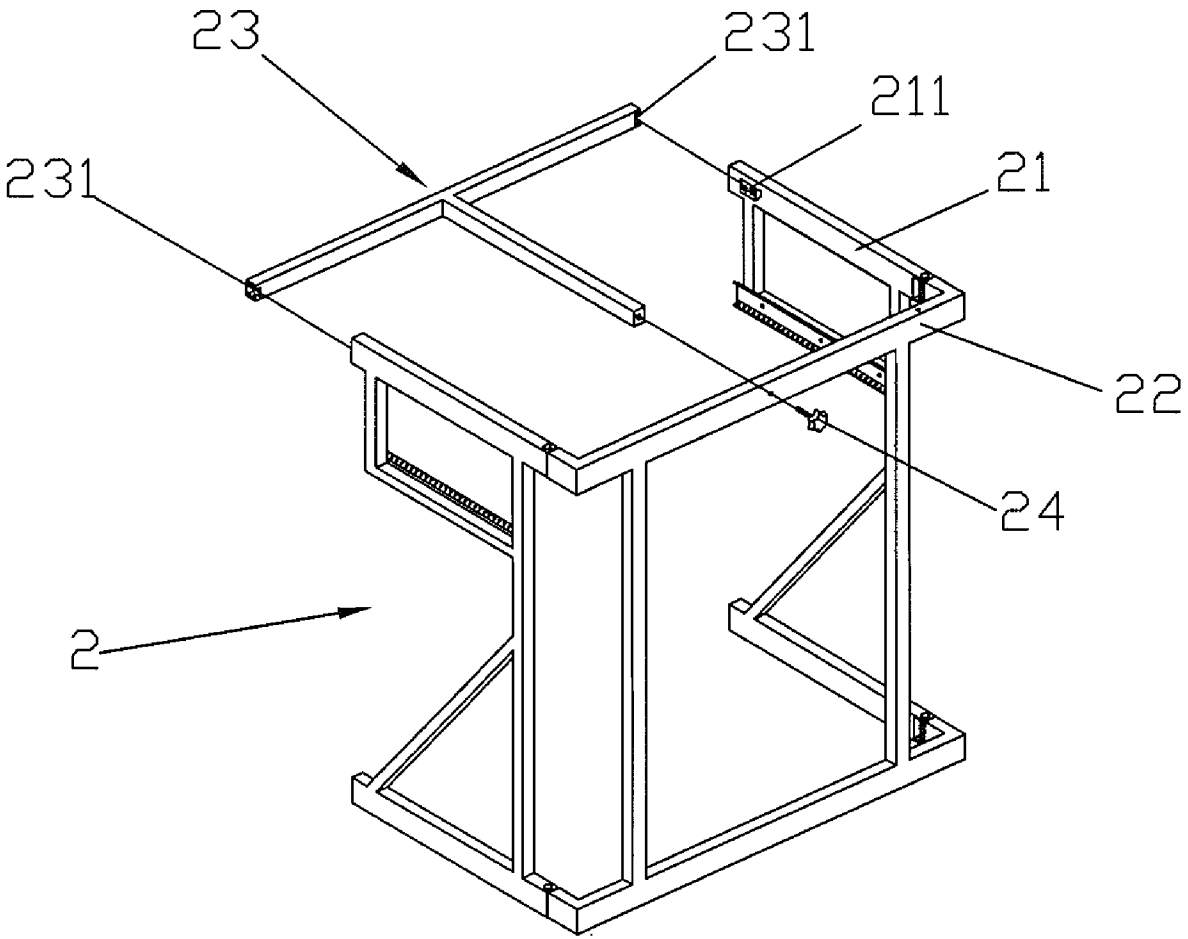
FIG. 10 is a partially exploded perspective view of the shelf as shown in FIG. 9.

Referring to FIGS. 9 and 10, a shelf 2 in accordance with the preferred embodiment of the present invention is used for supporting an electronic appliance, such as a computer and the like. The shelf 2 comprises a rear frame 22, two side frames 21 pivotally mounted on two opposite ends of the rear frame 22 respectively, and at least one connecting frame 23 detachably mounted on the rear frame 22 and located between the two side frames 21 to locate the two side frames 21. Each of the two side frames 21 has a front end having an upper portion provided with a locking block 211. The locking block 211 of each of the two side frames 21 has a substantially dovetailed shape. The connecting frame 23 has a rear side detachably mounted on the rear frame 22 by at least one threaded fastening knob 24. The connecting frame 23 has a front side having two opposite ends each provided with a locking groove 231 locked onto the locking block 211 of each of the two side frames 21 to lock the connecting frame 23 onto each of the two side frames 21. The locking groove 231 of the connecting frame 23 has a substantially dovetailed shape.

Figure 11:
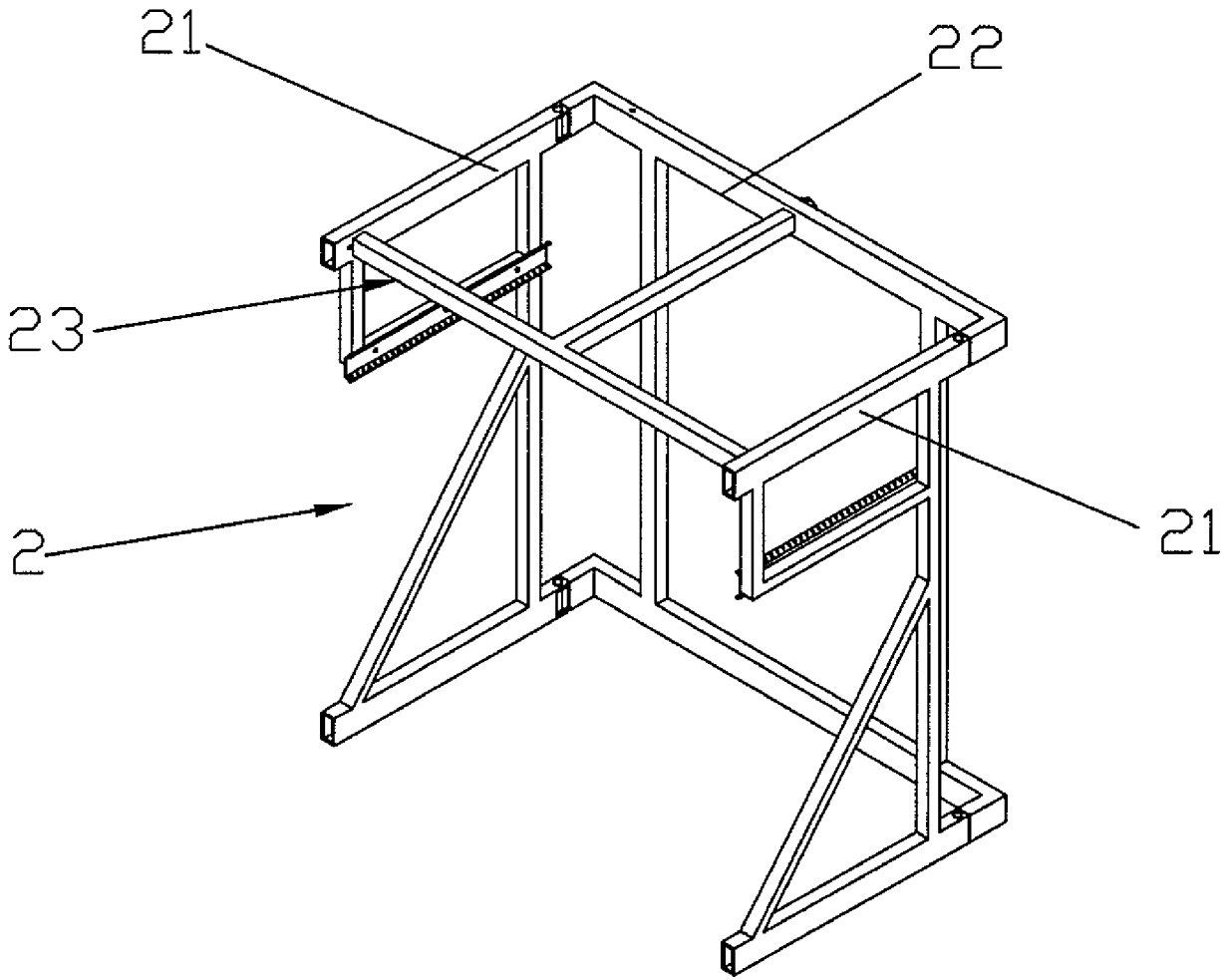
FIG. 11 is a perspective view of a shelf in accordance with another preferred embodiment of the present invention.
Figure 12:
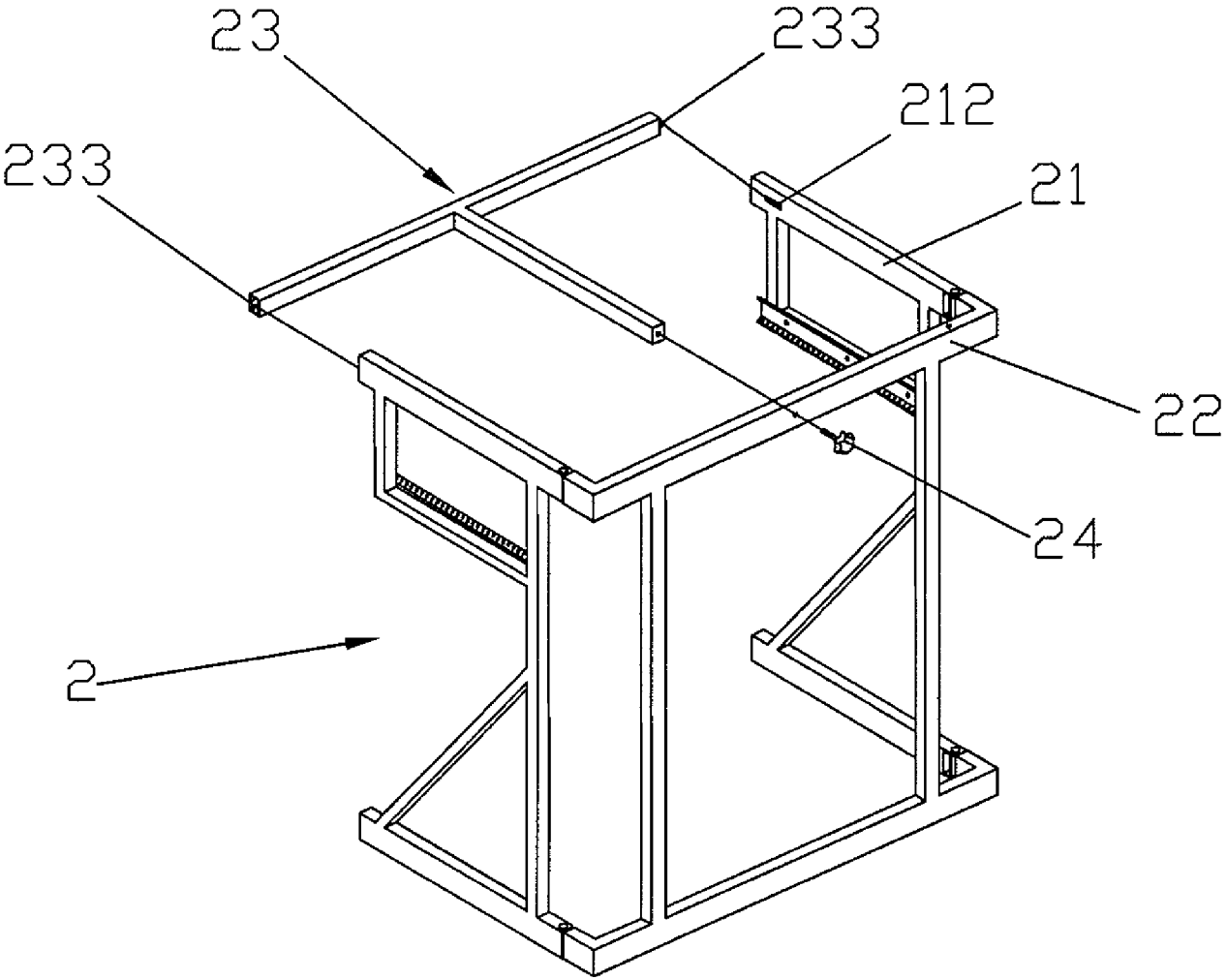
FIG. 12 is a partially exploded perspective view of the shelf as shown in FIG. 11.

Referring to FIGS. 11 and 12, each of the two side frames 21 has a front end having an upper portion provided with a locking slot 212, and the connecting frame 23 has a front side having two opposite ends each provided with a locking ear 233 locked onto the locking slot 212 of each of the two side frames 21 to lock the connecting frame 23 onto each of the two side frames 21.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A shelf comprising:

a rear frame;

two side frames pivotally mounted on two opposite ends of the rear frame respectively;

two connecting frames each fixed on the rear frame and each located between the two side frames to locate the two side frames; and at least one placement board mounted between and by fixed on the rear frame and the two side frames, wherein:

the placement board is locked onto the rear frame and the two side frames by a plurality of threaded locking knobs;

the placement board has a surface formed with a plurality of screw bores;

the rear frame has a surface formed with a plurality of through holes;

corresponding ones of the plurality of threaded locking knobs are in turn extended through corresponding ones of the plurality of through holes of the rear frame and screwed into corresponding ones of the plurality of screw bores of the placement board;

each of the side frames has a surface formed with a plurality of through bores;

corresponding ones of the plurality of threaded locking knobs are in turn extended through corresponding ones of the plurality of through bores of each of the side frames and screwed into corresponding ones of the plurality of screw bores of the placement board;

each of the two opposite ends of the rear frame has an upper portion and a lower portion each provided with a first pivot portion;

each of the two side frames has a rear end having an upper portion and a lower portion each provided with a second pivot portion pivotally connected with the respective first pivot portion of the rear frame by a pivot pin;

whereby the rear end of each of the two side frames is pivotally connected with the rear frame;

each of the two side frames has a front end having an upper portion and a lower portion each provided with a locking block;

each of the two connecting frames has a front side having two opposite ends each provided with a locking groove locked onto the locking block of each of the two side frames to lock each of the two connecting frames onto each of the two side frames;

the locking block of each of the two side frames has a substantially dovetailed shape; and the locking groove of each of the two connecting frames has a substantially dovetailed shape.

2. The shelf of claim 1, wherein each of the two connecting frames has a rear side detachably mounted on the rear frame by at least one threaded fastening knob.

3. The shelf of claim 1, wherein each of the two connecting frames includes a lengthwise bar mounted between the two side frames and at least one crosswise bar mounted between the lengthwise bar and the rear frame.

* * * * *